US009580973B2

(12) United States Patent
Johnson et al.

(10) Patent No.: US 9,580,973 B2
(45) **Date of Patent: *Feb. 28, 2017**

(54) METHOD AND SYSTEM FOR DATA-TRANSFER VIA A DRILL PIPE

(71) Applicant: REI, Inc., Salt Lake City, UT (US)

(72) Inventors: Randall Johnson, Salt Lake City, UT (US); Michael J. Hardin, Draper, UT (US); Randy Richardson, South Jordan, UT (US); Daniel J. Brunner, Sandy, UT (US)

(73) Assignee: REI, Inc., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/073,340

(22) Filed: Mar. 17, 2016

(65) Prior Publication Data

US 2016/0194923 A1 Jul. 7, 2016

Related U.S. Application Data

(63) Continuation of application No. 13/800,688, filed on Mar. 13, 2013, now Pat. No. 9,322,223.
(Continued)

(51) Int. Cl.

| | |
|---|---|
| ***E21B 17/02*** | (2006.01) |
| ***E21B 47/01*** | (2012.01) |
| ***E21B 47/12*** | (2012.01) |
| ***E21B 17/00*** | (2006.01) |
| ***E21B 19/16*** | (2006.01) |

(52) U.S. Cl.
CPC ..... *E21B 17/028* (2013.01); *E21B 17/003* (2013.01); *E21B 19/16* (2013.01); *E21B 47/01* (2013.01); *E21B 47/12* (2013.01); *E21B 47/122* (2013.01); *Y10T 29/49117* (2015.01)

(58) Field of Classification Search
CPC ..... E21B 17/028; E21B 47/12; E21B 47/01; E21B 17/02; E21B 47/122; Y10T 29/49117
See application file for complete search history.

(56) References Cited

U.S. PATENT DOCUMENTS 3,518,609 A * 6/1970 Fontenot, Jr. ..... E21B 17/028 175/104
4,126,848 A 11/1978 Denison
(Continued)

FOREIGN PATENT DOCUMENTS

SU 620577 A1 8/1978

OTHER PUBLICATIONS

Copenheaver, Blaine R., "International Search Report" prepared for PCT/US2013/031982 as mailed May 31, 2013, 3 pages.

*Primary Examiner* — Yong-Suk (Philip) Ro
(74) *Attorney, Agent, or Firm* — Winstead PC

(57) ABSTRACT

The present invention relates to a drill-pipe communication assembly. The drill-pipe communication assembly includes a first drill pipe and an insulated tube disposed within, and generally concentric with, the first drill pipe. A male insert is disposed within a first end of the first drill pipe and a female insert is disposed within a second end of the first drill pipe. A conductor is electrically coupled to the male insert and the female insert. The conductor extends along a length of the first drill pipe. The conductor facilitates transmission of electrical signals from the first end of the first drill pipe to the second end of the first drill pipe.

17 Claims, 11 Drawing Sheets

Related U.S. Application Data

(60) Provisional application No. 61/644,896, filed on May 9, 2012.

(56) References Cited

U.S. PATENT DOCUMENTS

| | | | |
|---|---|---|---|
| 4,483,393 | A | 11/1984 | More et al. |
| 4,785,247 | A | 11/1988 | Meador et al. |
| 4,921,438 | A | 5/1990 | Godfrey et al. |
| 2004/0169367 | A1 | 9/2004 | Sutherland et al. |
| 2004/0242044 | A1 | 12/2004 | Head |
| 2006/0225926 | A1 | 10/2006 | Madhavan et al. |
| 2013/0319768 | A1 | 12/2013 | Madhavan et al. |

* cited by examiner

METHOD AND SYSTEM FOR DATA-TRANSFER VIA A DRILL PIPE

CROSS-REFERENCE TO RELATED APPLICATIONS

This application is a continuation of U.S. patent application Ser. No. 13/800,688, filed Mar. 13, 2013. U.S. patent application Ser. No. 13/800,688 claims priority to the entire disclosure of, U.S. Provisional Patent Application No. 61/644,896, filed May 9, 2012. U.S. patent application Ser. No. 13/800,688 and U.S. Provisional Patent Application No. 61/644,896 are incorporated herein by reference.

BACKGROUND

Field of the Invention

The present application relates generally to drilling and mining operations and more particularly, but not by way of limitation, to a drill pipe having an insulated conductor embedded therein for transmission of data.

History of the Related Art

The practice of drilling non-vertical wells through directional drilling (sometimes referred to as "slant drilling") has become very common in energy and mining industries. Directional drilling exposes a larger section of subterranean reservoirs than vertical drilling, and allows multiple subterranean locations to be reached from a single drilling location thereby reducing costs associated with operating multiple drilling rigs. In addition, directional drilling often allows access to subterranean formations where vertical access is difficult or impossible such as, for example, formations located under a populated area or formations located under a body of water or other natural impediment.

Despite the many advantages of directional drilling, the high cost associated with completing a well is often cited as the largest shortcoming of directional drilling. This is due to the fact that directional drilling is often much slower than vertical drilling due to requisite data-acquisition steps. Data acquisition requires an electrical connection to be present between a down-hole tool and surface equipment. Embedding an electrical conductor into a drill rod expedites data acquisition associated with directional drilling and reduces overall costs associated with directional drilling.

SUMMARY

The present application relates generally to drilling and mining operations and more particularly, but not by way of limitation, to a drill pipe having an insulated conductor embedded therein for transmission of data. In one aspect, the present invention relates to a drill-pipe communication assembly. The drill-pipe communication assembly includes a first drill pipe and an insulated tube disposed within, and generally concentric with, the first drill pipe. A male insert is disposed within a first end of the first drill pipe and a female insert is disposed within a second end of the first drill pipe. A conductor is electrically coupled to the male insert and the female insert. The conductor extends along a length of the first drill pipe. The conductor facilitates transmission of electrical signals from the first end of the first drill pipe to the second end of the first drill pipe.

In another aspect, the present invention relates to a method of installing a drill-pipe communication assembly. The method includes inserting a female insert into a first end of a drill pipe and inserting an insulated tube into a second end of the drill pipe. The method further includes inserting a male insert into the second end of the drill pipe. A conductor is electrically coupled to the female insert and the male insert. Electrical signals are transmitted, via the conductor, from the first end of the drill pipe to the second end of the drill pipe.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
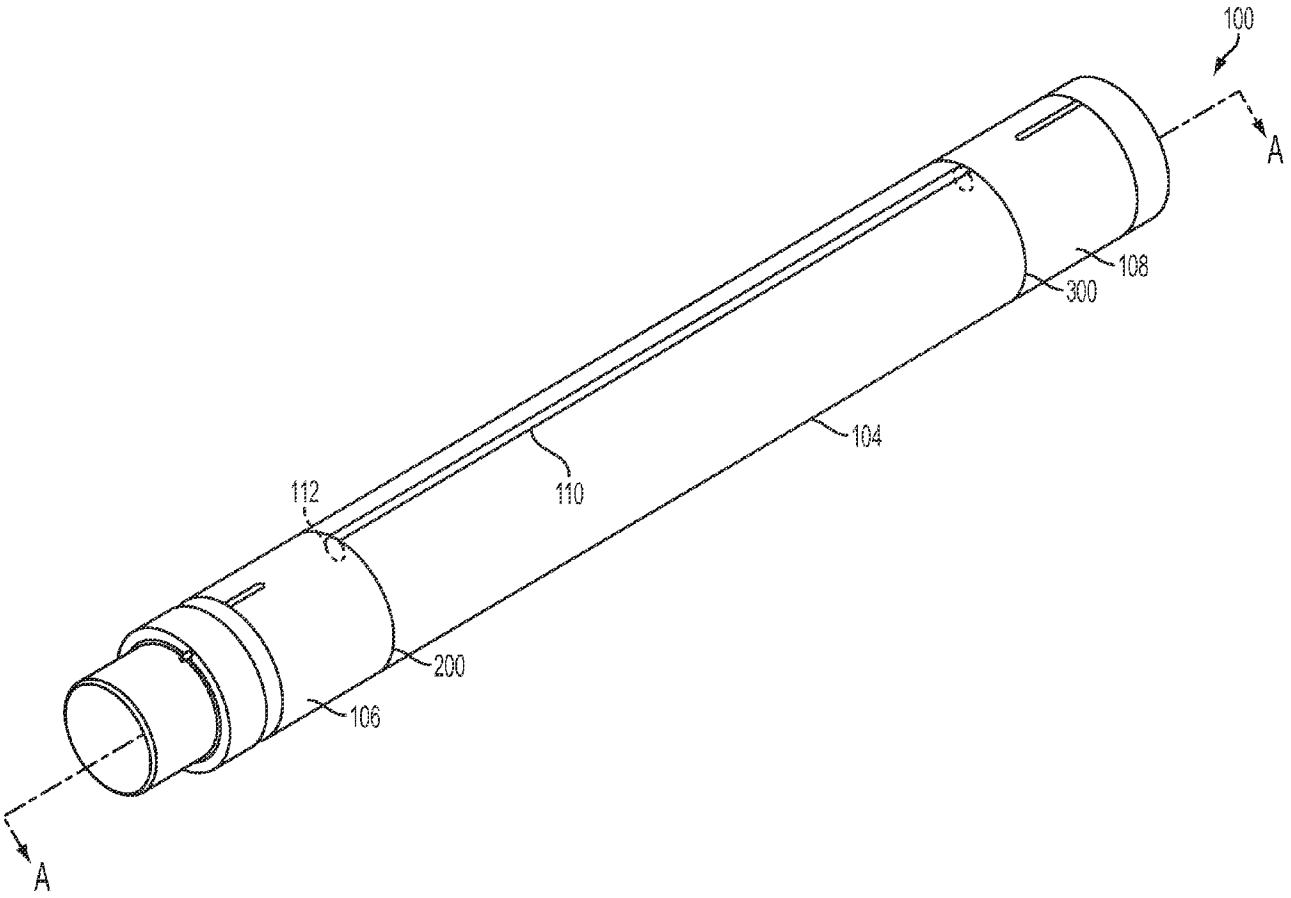
FIG. 1 is a perspective view of a drill-pipe communication assembly according to an exemplary embodiment.

FIG. 1 is a perspective view of a drill-pipe communication assembly 100. In a typical embodiment, the drill-pipe communication assembly 100 is disposed within a drill pipe 402 (shown in FIG. 4A). An insulated tube 104 is disposed within the drill pipe 402. In a typical embodiment, the insulated tube 104 is constructed of an electrically-non-conductive material such as, for example, ABS plastic, carbon fiber, ceramic, or other appropriate material. A male insert 106 abuts a first end 200 and a female insert 108 abuts a second 300 end of the insulated tube. In a typical embodiment the drill pipe is constructed of, for example, steel or other appropriate material. A groove 110 is formed in an outer surface of the insulated tube 104 and is oriented generally parallel to a length of the insulated tube 104. A conductor 112 is disposed in the groove 110 and is electrically coupled to the male insert 106 and the female insert 108. In a typical embodiment, the conductor 112 is, for example, a co-axial cable. However, in other embodiments, drill-pipe communication assemblies utilizing principles of the invention may include conductors such as, for example, a microstrip, flat or ribbon wire, an Ethernet cable, a fiber-optic cable, a transverse electromagnetic transmission line such as, for example, stripline, or other appropriate conductor as dictated by design requirements.

Figure 2A:
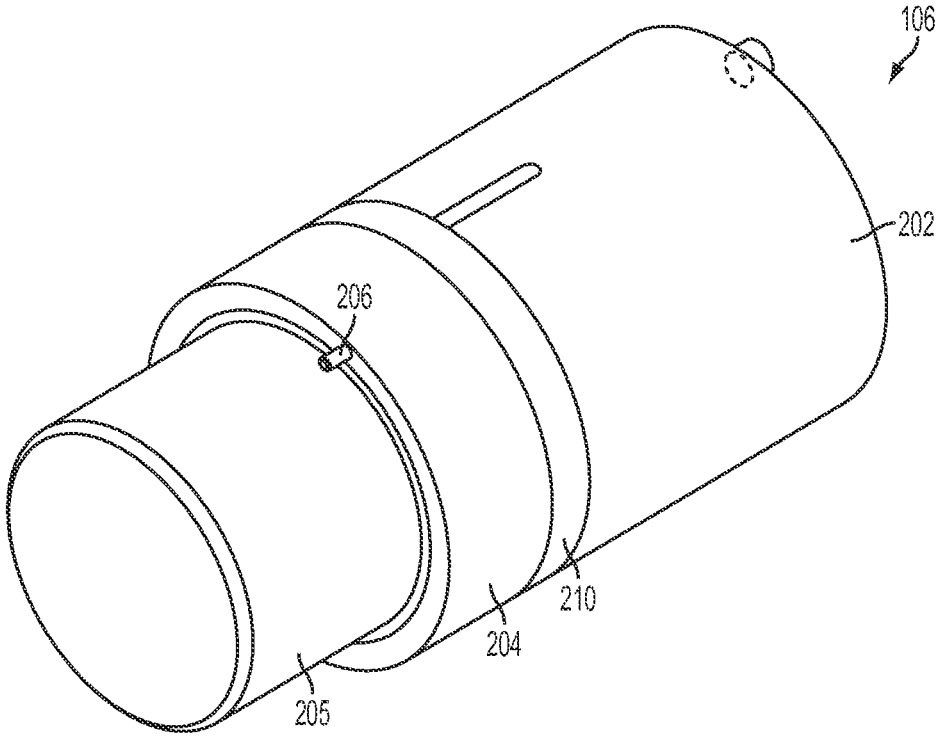
FIG. 2A is a perspective view of a male insert according to an exemplary embodiment.
Figure 2B:
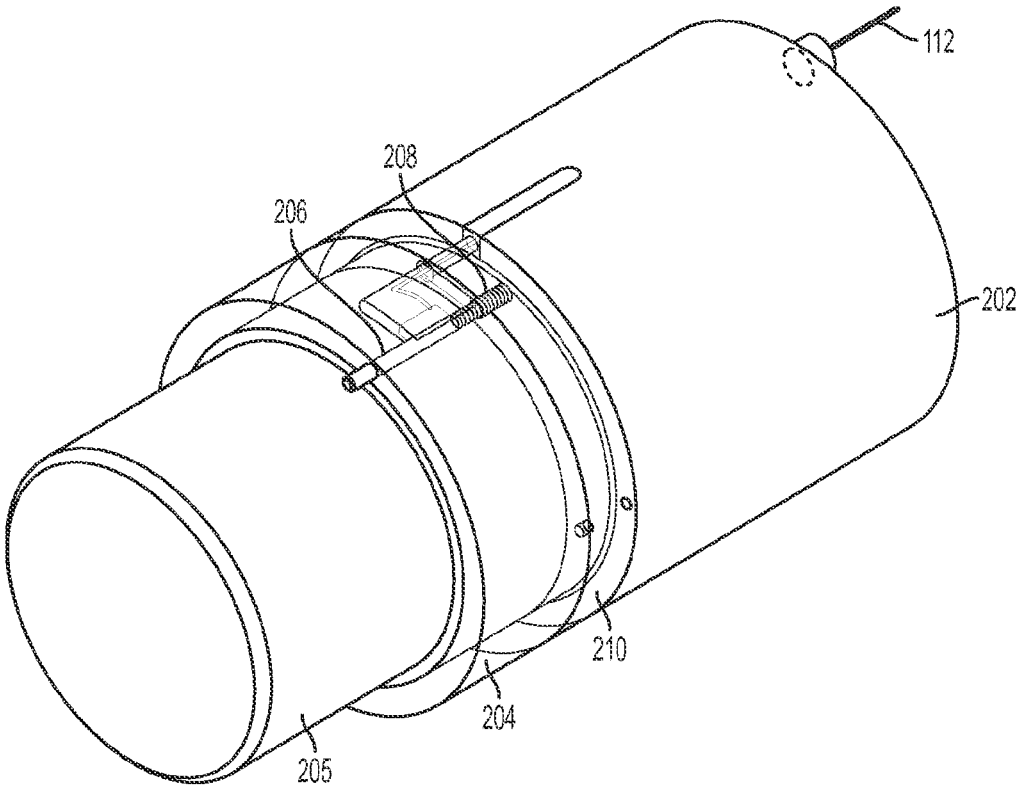
FIG. 2B is a perspective view of the male insert of FIG. 2A with an insulating ring shown as transparent according to an exemplary embodiment.

FIG. 2A is a perspective view of the male insert 106. FIG. 2B is a perspective view of the male insert 106 with a first insulating ring and a second insulating ring shown as transparent. Referring to FIGS. 2A and 2B, in a typical embodiment, the male insert 106 is operable to couple with a female insert 108 (shown in FIG. 1) associated with an adjacent drill pipe (not shown). The male insert includes a body 202, a first insulating ring 204 surrounding a portion of the body 202, a second insulating ring 210 surrounding a portion of the body 202 and positioned adjacent to the first insulating ring 204, and a pin 206 disposed through the first insulating ring 204. In a typical embodiment the body 202 is constructed from a material such as, for example, stainless steel; however, in other embodiments, other materials may be utilized. A rabbet 205 is formed in the body 202 and the first insulating ring 204 and the second insulating ring 210 disposed about a circumference of the rabbet 205. In a typical embodiment, the pin 206 is electrically coupled to the conductor 112 and is constructed of an electrically-conductive material such as, for example copper, aluminum, or other appropriate material. As shown in FIG. 2B, a spring 208 is disposed within the insulating ring 204 between the pin 206 and the second insulating ring 210. In a typical embodiment, the spring 208 biases the pin 206 in a forward direction to facilitate electrical contact between the male insert 106 and a female insert 108 (shown in FIG. 1) associated with an adjacent drill pipe (not shown). In a typical embodiment, the conductor 112, the pin 206, and the female conductor ring 306 (shown in FIGS. 3A-3B) form a continuous wire line capable of transmitting data in the form of electrical signals between the male insert 106 and the female insert 108.

Figure 3A:
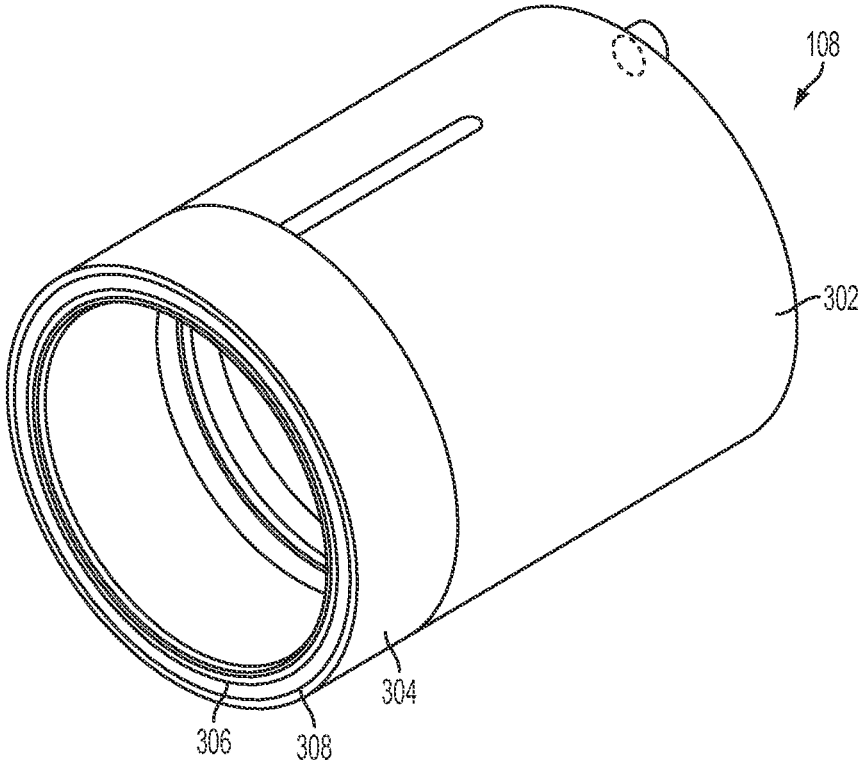
FIG. 3A is a perspective view of a female insert according to an exemplary embodiment.
Figure 3B:
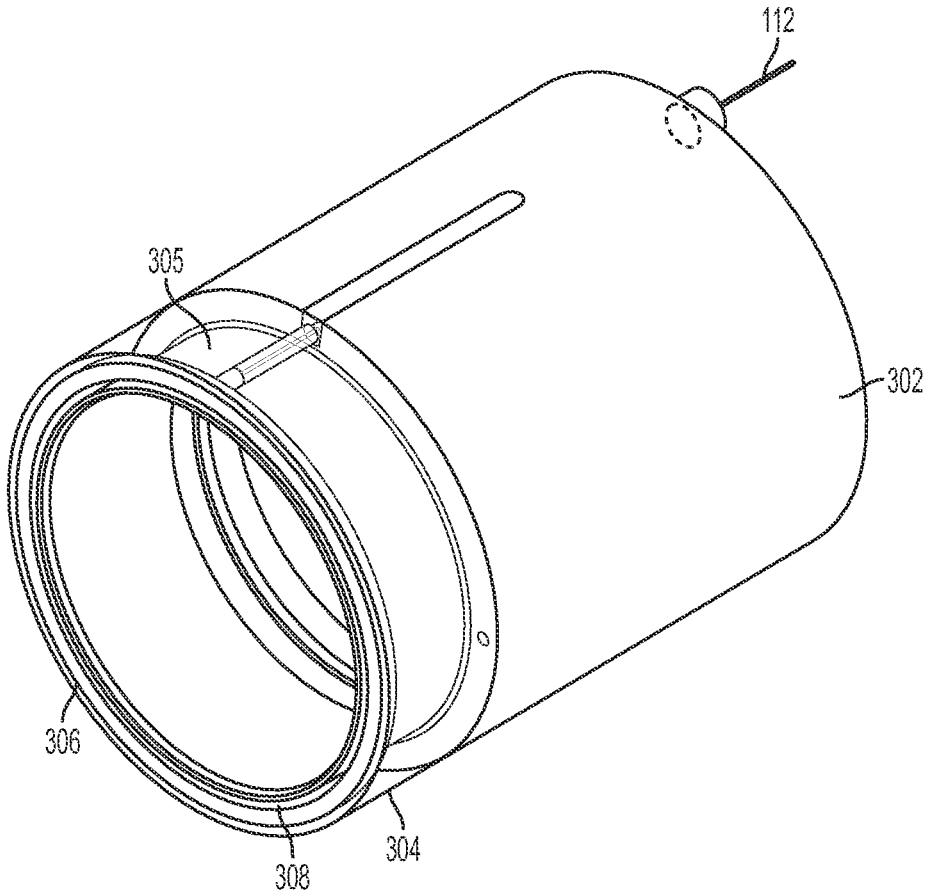
FIG. 3B is a perspective view of the female insert of FIG. 3B with an insulating ring shown as transparent according to an exemplary embodiment.

FIG. 3A is a perspective view of the female insert 108. FIG. 3B is a perspective view of the female insert 108 with an insulating ring shown as transparent. In a typical embodiment, the female insert 108 is, for example, operable to couple with a male insert 106 (shown in FIG. 1) of an adjacent drill pipe (not shown). The female insert 108 includes a body 302, an insulating ring 304 disposed about the body 302, and a female conductor ring 306. In a typical embodiment, the body 302 is constructed from a material such as, for example, stainless steel; however, in other embodiments, other materials may be utilized. A rabbet 305 is formed in the body 302 and the insulating ring 304 is disposed about a circumference of the rabbet 305. In a typical embodiment, the female conductor ring 306 is constructed of an electrically-conductive material such as, for example copper, aluminum, or other appropriate material. The female conductor ring 306 is disposed within a groove 308 formed in an outer face of the insulating ring 304. In a typical embodiment, the groove 308 forms a track that receives a pin (not shown) associated with a male insert 106 (shown in FIG. 1) of an adjacent drill pipe (not shown). The groove 308 facilitates contact between the pin 206 of an adjacent drill pipe and the female conductor ring 306. As shown in FIG. 3B, the female conductor ring 306 is electrically coupled to the conductor 112. Thus, combination of the pin 206, the female conductor ring 306, and the conductor 112 allows transmission of electrical signals from, for example, the male insert 106 to the female insert 108.

Figure 4A:
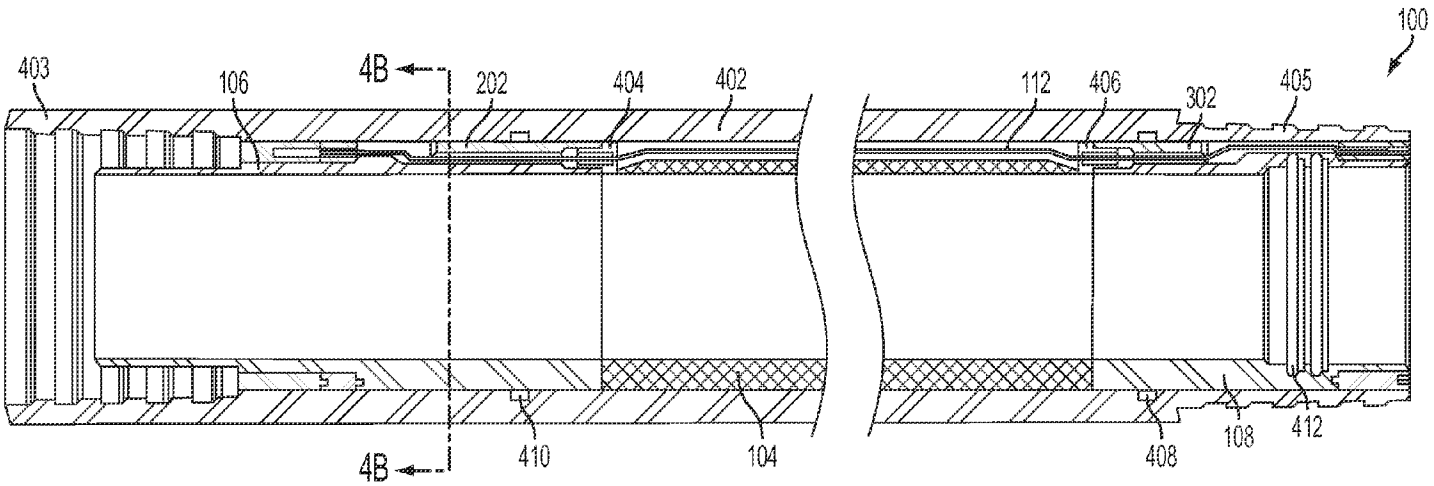
FIG. 4A is a cross-sectional view along the line A-A of the drill-pipe communication assembly of FIG. 1 according to an exemplary embodiment.
Figure 4B:
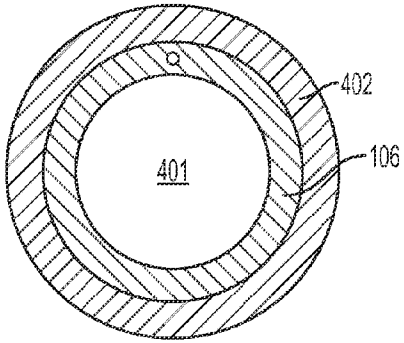
FIG. 4B is a cross-sectional view along the line B-B of the drill-pipe communication assembly of FIG. 4A according to an exemplary embodiment.

FIG. 4A is a cross-sectional view along the line A-A of the drill-pipe communication assembly 100. FIG. 4B is a cross-sectional view along the line B-B of the drill-pipe communication assembly 100. Referring to FIGS. 4A-4B, the insulated tube 104 is received within, and is generally concentric with, the drill pipe 402. A central space 401 is formed within an interior of the insulated tube 104. The central space 401 allows for transmission of fluids, tools, and other items through the drill-pipe communication assembly 100. The insulated tube 104 insulates the conductor 112 from materials that may be present in the central space 401. Thus, the drill-pipe communication assembly 100 allows data related to, for example, tool depth and telemetry, to be transmitted, via the conductor 112, without blocking or otherwise reducing a size of the central space 401.

Still referring to FIGS. 4A and 4B, the male insert 106 is inserted into a female end 403 of the drill pipe 402 and the female insert 108 is inserted into a male end 405 of the drill pipe 402. The male insert 106 abuts the first end 200 (shown in FIG. 1) of the insulated tube 104 and the female insert 108 abuts the second end 300 (shown in FIG. 1) of the insulated tube 104. The conductor 112 is electrically coupled to both the male insert 106 and the female insert 108. The conductor 112 traverses a length of the insulated tube 104 between the male insert 106 and the female insert 108. Thus, the combination of the conductor 112, the male insert 106, and the female insert 108 allows transmission of electrical signals along a length of the drill pipe 402. A first compression grommet 404 is disposed in the body 202 of the male insert 106. The first compression grommet 404 is disposed about the conductor 112. In a typical embodiment, the first compression grommet 404 prevents infiltration of, for example, water or drilling fluids, into the male insert 106. A second compression grommet 406 is disposed in the body 302 of the female insert 108. The second compression grommet 406 is disposed about the conductor 112. In a typical embodiment, the second compression grommet 406 prevents infiltration of, for example, water or drilling fluids, into the female insert 108.

Still referring to FIGS. 4A-4B, a first seal 408 is disposed about an interior circumference of the drill pipe 402 proximate to the female insert 108. In a typical embodiment, the first seal 408 includes a single O-ring; however, in alternate embodiments, the first seal 408 may include a double O-ring, a gasket, or other sealing device as dictated by design requirements. During operation, the first seal 408 prevents infiltration of, for example, fluid and other contaminants into a region of the drill pipe 402 containing the female insert 108. A second seal 410 is disposed about an interior circumference of the drill pipe 402 proximate to the male insert 106. In a typical embodiment, the second seal 410 includes a single O-ring; however, in alternate embodiments, the second seal 410 may include a double O-ring, a gasket, or other sealing device as dictated by design requirements. During operation, the second seal 410 prevents infiltration of, for example, fluid and other contaminants into a region of the drill pipe 402 containing the male insert 106. A third seal 412 is disposed about an interior circumference of the female insert 108. In a typical embodiment, the third seal 412 includes a double O-ring; however, in other embodiments, the third seal 412 may include a single O-ring or other sealing device as dictated by design requirements. During operation, the third seal 412 seats on a circumferential face of the male insert 106 and prevents infiltration of, for example, fluid and other contaminants into a region of the drill pipe 402 containing a junction between the male insert 106 and the female insert 108.

Figure 5A:
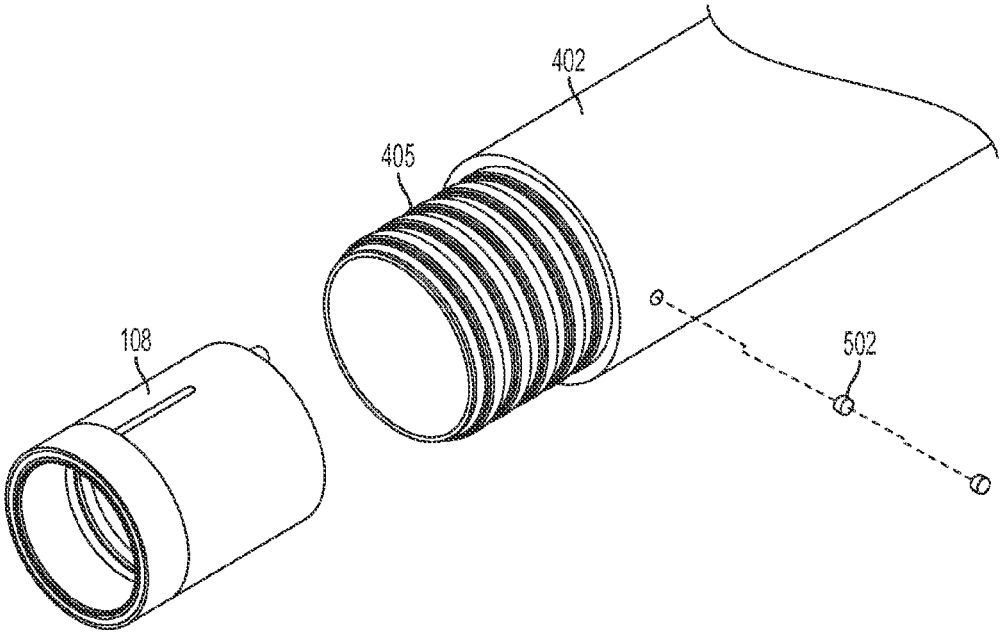
FIG. 5A is an exploded perspective view of a female insert of FIG. 3A illustrating assembly with a drill rod according to an exemplary embodiment.
Figure 5B:
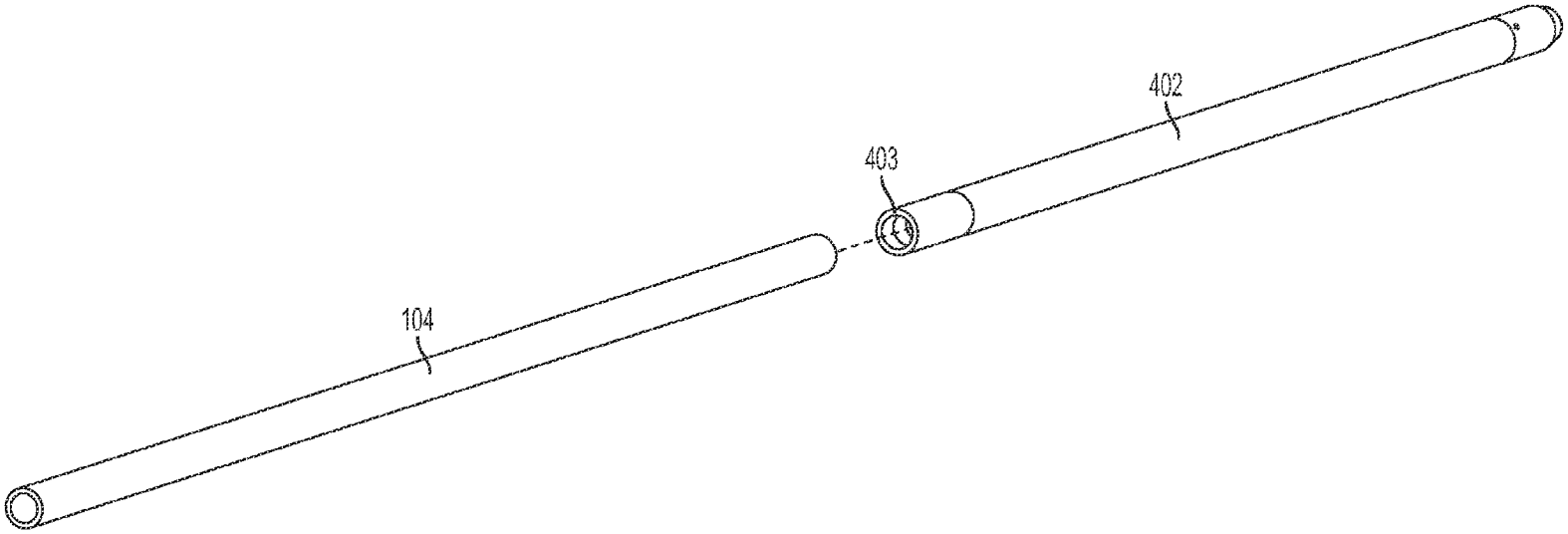
FIG. 5B is an exploded perspective view of an insulated tube illustrating assembly with a drill rod according to an exemplary embodiment.
Figure 5C:
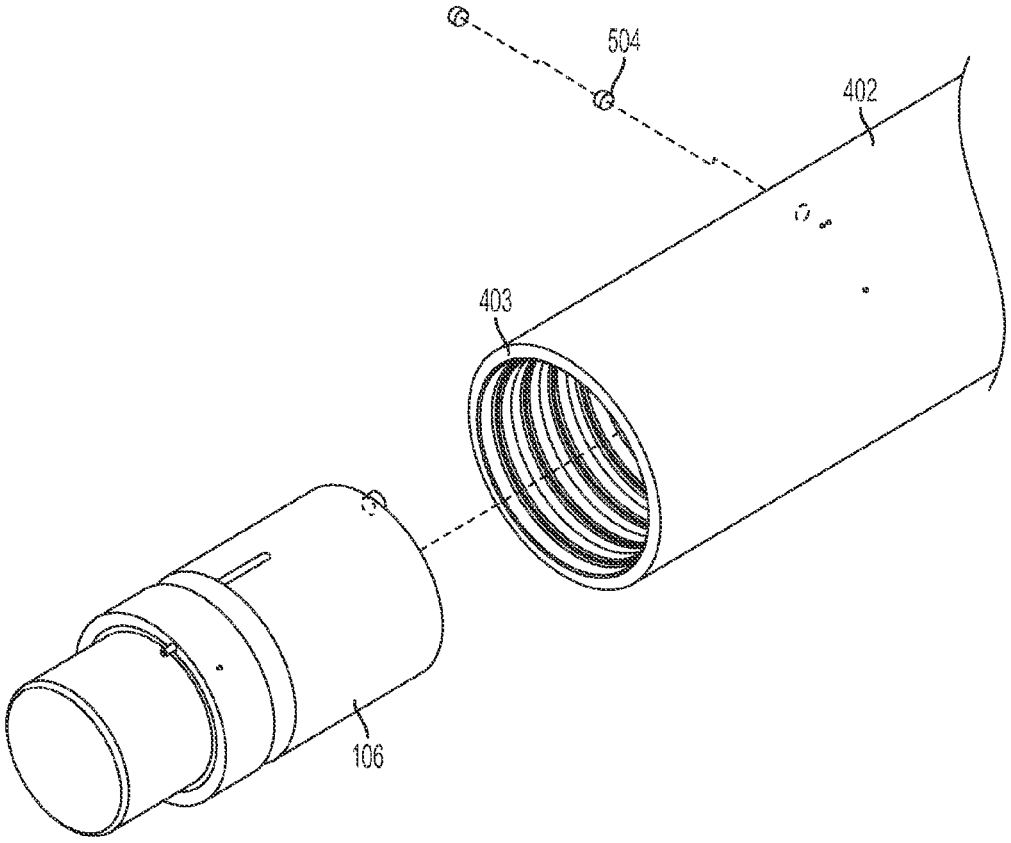
FIG. 5C is an exploded perspective view of the male insert of FIG. 2A illustrating assembly with a drill rod according to an exemplary embodiment.

FIG. 5A is an exploded perspective view of the female insert 108 illustrating assembly with the drill pipe 402. FIG. 5B is an exploded perspective view of the insulated tube 104 illustrating assembly with the drill pipe 402. FIG. 5C is an exploded perspective view of the male insert 106 illustrating assembly with the drill pipe 402. As will be illustrated in FIGS. 5A-5C, the drill-pipe communication assembly 100 may be utilized in combination with a pre-existing drill pipe. Thus, the drill-pipe communication assembly 100 allows previously unwired drill pipe to be retro-fitted to allow data transfer.

As shown in FIG. 5A, the female insert 108 is inserted into a male end 405 of the drill pipe 402. The female insert 108 is held in place within the drill pipe 402 via first fasteners 502 or a press fit. In a typical embodiment, the first fasteners 502 are, for example, set screws; however, in other embodiments, the first fasteners 502 may be, for example, pins, rivets, or any other appropriate fastener as dictated by design requirements. As shown in FIG. 5B, the insulated tube 104 is inserted into a female end 403 of the drill pipe 402. As discussed hereinabove, the groove 110, having the conductor 112 disposed therein, is formed in the insulated tube 104. The conductor 112 is electrically coupled to the female insert 108. In a typical embodiment, insertion of the insulated tube 104 occurs after insertion of the female insert 108. As shown in FIG. 5C, the male insert 106 is inserted into a female end 403 of the drill pipe 402. The male insert 106 is held in place within the drill pipe 402 via second fasteners 504 or a press fit. In a typical embodiment, the second fasteners 504 are, for example, set screws; however, in other embodiments, the second fasteners 504 may be, for example, pins, rivets, or any other appropriate fastener as dictated by design requirements.

Figure 6:
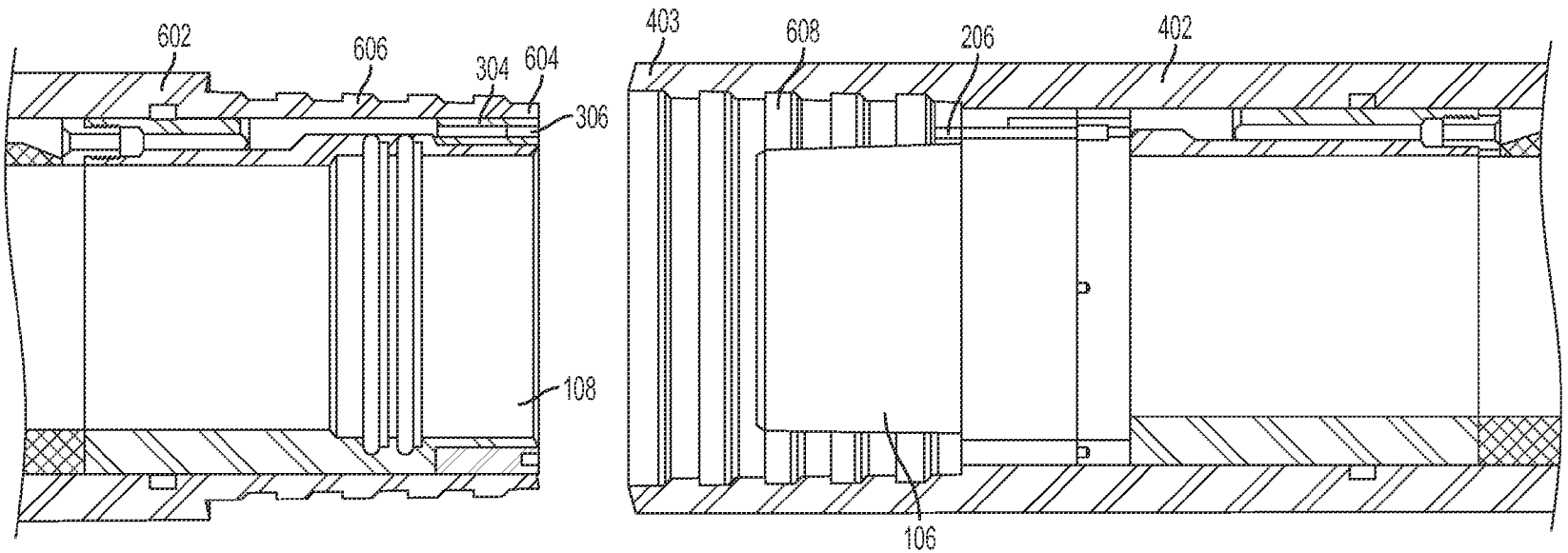
FIG. 6 is a cross-section view of a junction between two adjacent drill pipes according to an exemplary embodiment.

FIG. 6 is a cross-sectional view of a junction between, for example, the female end 403 of the drill pipe 402 and a male end 604 of an adjacent drill pipe 602. As shown in FIG. 6, the male end 604 includes, for example, male threads 606 and the female end 403 includes, for example, female threads 608. The male insert 106 is disposed in the female end 403 and the female insert 108 is disposed in the male end 604. Upon engagement of the male threads 606 with the female threads 608, the pin 206 engages the female conductor ring 306 disposed in the groove 308 thereby facilitating an electrical connection between the drill pipe 402 and the adjacent drill pipe 602. Such an electrical connection allows the transmission of, for example, measurements, telemetry, and other data obtained by a downhole tool to, for example surface instrumentation.

The advantages of the drill-pipe communication assembly 100 will be apparent to those skilled in the art. First, the drill-pipe communication assembly 100 provides a continuous wire line for transmission of electrical signals from, for example, a down-hole tool to surface drilling equipment via the conductor 112, the pin 206, and the female conductor ring 306. Second, the drill-pipe communication assembly 100 allows for the passage of fluids, tools, and other items through the central space 401. Third, the insulated tube 104, including the conductor 112, the pin 206, and the female conductor ring 306, may be assembled during a manufacturing process for the drill pipe 402 or after manufacturing of a drill pipe. In this sense, the drill-pipe communication assembly 100 allows the existing drill pipe 402 to be fitted or retro-fitted.

Figure 7:
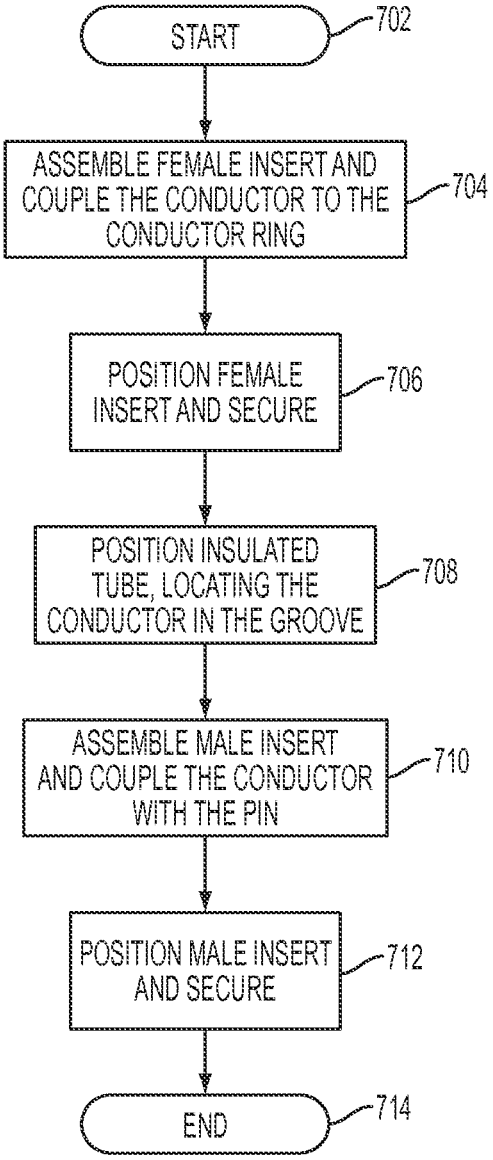
FIG. 7 is a flow diagram of a process for installing the drill-pipe communication assembly of FIG. 1 according to an exemplary embodiment.

FIG. 7 is a flow diagram of a process 700 for installing the drill-pipe communication assembly 100. The process 700 begins at step 702. At step 704, the female conductor ring 108 is assembled and coupled to the conductor 112. At step 706, the female insert 108 is positioned and secured in the male end 405 of the drill pipe 402. At step 708, the insulated tube 104 is inserted into the female end 403 of the drill pipe 402. At step 710, the male insert 106 is assembled and coupled to the conductor 112. At step 712, the male insert is positioned and secured in the female end 403 of the drill pipe 402. The process ends at step 714.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A drill-pipe communication assembly comprising:

a first drill pipe segment, the first drill pipe segment comprising:

a male insert comprising:

a body;

a first insulating ring disposed about the body;

a second insulating ring disposed about the body;

and a pin, the pin being disposed through the first insulating ring, the pin being extended from a bottom of the first insulated ring, the pin being electrically coupled to a conductor;

second drill pipe segment that is operatively coupled to the first drill pipe segment, the first drill pipe segment and the second drill pipe segment comprising:

the conductor extending along a length of the first drill pipe, wherein the conductor facilitates transmission of electrical signals a first end of the first drill pipe segment to a second end of the first drill pipe segment; and wherein the pin is biased by a spring into electrical engagement with a female conductor ring associated with the second drill pipe segment, the spring being disposed between the pin and the second insulating ring.

2. The drill-pipe communication assembly of claim 1, comprising:

a female insert comprising:

a body;

an insulating ring disposed about the body; and the female conductor ring disposed within a groove formed in the insulating ring, the female conductor ring being electrically coupled to the conductor.

3. The drill-pipe communication assembly of claim 2, wherein the groove and the female conductor ring form a recessed track.

4. The drill-pipe communication assembly of claim 1, wherein:

the first end of the first drill pipe segment is a male end; and the second end of the first drill pipe segment is a female end.

5. The drill-pipe communication assembly of claim 1, wherein the conductor is at least one of a coaxial cable, a microstrip, a flat wire, a ribbon wire, an Ethernet cable, a fiber-optic cable, and a transverse electromagnetic transmission line.

6. The drill-pipe communication assembly of claim 1, comprising an insulated tube disposed in at least one of a first drill pipe segment and a second drill pipe segment.

7. The drill-pipe communication assembly of claim 6, wherein the conductor is disposed within a groove formed on a surface of the insulated tube.

8. The drill-pipe communication assembly of claim 1, wherein the male insert, a female insert, the conductor, and the insulated tube are utilized to retrofit a pre-existing drill pipe.

9. A method of installing a drill-pipe communication assembly, the method comprising:

inserting a female insert into a first end of a drill pipe;

inserting an insulated tube into a second end of the drill pipe;

inserting a male insert into the second end of the drill pipe;

electrically coupling a conductor to the female insert and the male insert; and biasing via a spring a pin associated with the male insert into electrical engagement with a female conductor ring associated with a second drill pipe, the spring being disposed between the pin and an insulating ring, wherein the in being disposed through the insulating ring, the in being extended from a bottom of the insulated ring, the in being electrically coupled to a conductor.

10. The method of claim 9, comprising transmitting, via the conductor, electrical signals from the first end of the drill pipe to the second end of the drill pipe.

11. The method of claim 9, wherein the first end is a male end and the second end is a female end.

12. The method of claim 9, wherein the conductor is disposed within a groove formed in the insulated tube.

13. The method of claim 9, comprising securing the female insert within the first end of the drill pipe.

14. The method of claim 9, comprising securing the male insert within the second end of the drill pipe.

15. The method of claim 9, wherein the female conductor ring is disposed in a groove.

16. The method of claim 9, wherein the drill pipe is a pre-existing drill pipe.

17. The method of claim 9, comprising retro-fitting the pre-existing drill pipe.

* * * * *